US009515422B2

(12) United States Patent
Karrasch et al.

(10) Patent No.: US 9,515,422 B2
(45) Date of Patent: Dec. 6, 2016

(54) ELECTRICAL CONNECTOR HAVING AN INTEGRATED IMPEDANCE EQUALISATION ELEMENT

(71) Applicant: Tyco Electronics AMP GmbH, Bensheim (DE)

(72) Inventors: Gregor Karrasch, Einhausen (DE); Daniel Volkmann, Lauteral (DE)

(73) Assignee: TE Connectivity Germany GmbH, Bensheim (DE)

( * ) Notice: Subject to any disclaimer, the term of this patent is extended or adjusted under 35 U.S.C. 154(b) by 26 days.

(21) Appl. No.: 14/386,186

(22) PCT Filed: Mar. 8, 2013

(86) PCT No.: PCT/EP2013/054781
§ 371 (c)(1),
(2) Date: Sep. 18, 2014

(87) PCT Pub. No.: WO2013/139631
PCT Pub. Date: Sep. 26, 2013

(65) Prior Publication Data

US 2015/0093934 A1 Apr. 2, 2015

(30) Foreign Application Priority Data

Mar. 22, 2012 (DE) ..... 10 2012 005 812

(51) Int. Cl.
*H01R 13/6594* (2011.01)
*H01R 13/6473* (2011.01)
(Continued)

(52) U.S. Cl.
CPC ..... *H01R 13/6473* (2013.01); *H01R 12/70* (2013.01); *H01R 12/724* (2013.01);
(Continued)

(58) Field of Classification Search
CPC ..... H01R 13/6594; H01R 13/6595; H01R 13/6587; H01R 13/6592; H01R 12/722; H01R 12/724
See application file for complete search history.

(56) References Cited

U.S. PATENT DOCUMENTS 4,914,062 A 4/1990 Voltz
7,108,552 B2 * 9/2006 Niitsu ..... H01R 23/6873 439/607.35
(Continued)

FOREIGN PATENT DOCUMENTS

EP 2017926 A2 1/2009
EP 2393167 A2 12/2011
WO WO 2010/124965 A1 11/2010

OTHER PUBLICATIONS

International Preliminary Report on Patentability issued by the International Bureau of WIPO, Geneva, Switzerland, dated Sep. 23, 2014 for International Application No. PCT/EP/2013/054781; 7 pages.
(Continued)

*Primary Examiner* — Gary Paumen
(74) *Attorney, Agent, or Firm* — Faegre Baker Daniels LLP

(57) ABSTRACT

The present invention relates to an electrical connector having an electrically insulating contact carrier and at least one electrically conductive contact element which is provided with an impedance equalization element. In particular, the present invention relates to an electrical connector which has defined impedance properties, both with and without shielding. In order to adjust the impedance of the connector (100) in at least a portion of the region in which the at least one contact element (104) is arranged, at least one impedance equalization element (112) is provided on the contact carrier (102) and integrated therewith, wherein the imped-
(Continued)

ance equalization element (112) has an electrically conductive, substantially planar structure, which is arranged with respect to the at least one contact element (104) with a predetermined spacing which is dependent on the impedance value to be adjusted.

10 Claims, 3 Drawing Sheets

(51) Int. Cl.

| | |
|---|---|
| ***H01R 12/72*** | (2011.01) |
| ***H01R 13/6464*** | (2011.01) |
| ***H01R 12/70*** | (2011.01) |
| ***H01R 13/658*** | (2011.01) |
| *H01R 43/24* | (2006.01) |

(52) U.S. Cl.
CPC ..... *H01R 13/6464* (2013.01); *H01R 13/658* (2013.01); *H01R 43/24* (2013.01)

(56) References Cited

U.S. PATENT DOCUMENTS

| | | | | |
|---|---|---|---|---|
| 8,188,369 | B2 * | 5/2012 | Cheng | H01R 13/6658 174/117 F |
| 8,672,711 | B2 * | 3/2014 | Kondo | H01R 12/57 439/607.1 |
| 2009/0023336 | A1 * | 1/2009 | Kondo | H01R 13/6474 439/607.01 |
| 2011/0092096 | A1 | 4/2011 | Jin et al. | |

OTHER PUBLICATIONS

International Search Report and Written Opinion issued by the European Patent Office dated Apr. 23, 2013, for related International Application No. PCT/EP2013/054781; 10 pages.

* cited by examiner

ELECTRICAL CONNECTOR HAVING AN INTEGRATED IMPEDANCE EQUALISATION ELEMENT

BACKGROUND

The present invention relates to an electrical connector having an electrically insulating contact carrier and at least one electrically conductive contact element which is provided with an impedance equalisation element. In particular, the present invention relates to an electrical connector which has defined impedance properties both with and without shielding.

Electrical connectors are known for connecting an extremely wide variety of electrical components and structures to each other, such as printed circuit boards, coaxial cables, separate circuit components, flexible circuits or the like. Generally, such connectors can produce signal and/or power supply lines between identical or similar components such as, for example, between two boards, but also between components which are not the same, such as, for example, a cable and a printed circuit board. Such plug type connectors are produced in a variety of forms and sizes, depending on the corresponding application. The form, size and spacing between the contacts of such a connector also vary significantly. Together with the form, size and spacing of the individual contacts, the impedance thereof also changes.

Since signal lines generally do not transmit any direct current, but instead only pulsed current or alternating current, so that no pulse reflections occur on the signal lines, it must be ensured that a uniform, that is to say, constant, impedance is provided. This is referred to as the so-called nominal impedance. Accordingly, when connecting lines, in particular in connection with a high-speed data transmission on associated plug type connectors, it must also be ensured that the constant impedance is maintained.

Various approaches are therefore known for adjusting a desired nominal impedance within an electrical connector using one or more contact elements. Thus, it is proposed, for example, in DE 10 2009 019 626 B3, in order to adjust the impedance of the connector, to arrange an electrically conductive impedance correction pin which is received in a bore. The bore is arranged symmetrically with respect to a plurality of contact elements.

However, it may be shown that the impedance which has been adjusted in this manner is clearly dependent on whether the plug type connector is additionally still surrounded by a shielding or not. For various applications, such as, for example, an Ethernet connection in a motor vehicle, it is highly dependent on the installation conditions whether or not a shielding against electromagnetic interspersions is necessary. In principle, for reasons of cost, the unshielded plug connector variant is always preferred and the shielding is fitted only as an alternative solution in special cases.

There is therefore a requirement for an electrical connector with a defined impedance whose impedance value can be influenced only in an insignificant manner by the presence or the absence of an electromagnetic shielding.

From U.S. Pat. No. 6,749,444 B2 there is known an electrical connector having a replaceable impedance tuner. This adjustment element is produced from a dielectric and further has impedance-adjusting metal plates which are arranged parallel with the contacts. These plates are received in the tuner and can be removed from it. The dielectric tuner can also be removed as a whole from the plug connector housing and replaced with a different tuner if another impedance value is desired. In contrast to the present invention, however, the impedance tuner according to U.S. Pat. No. 6,749,444 B2 is secured to the connector by means of a metal casing which surrounds the connector. That is to say, the impedance which is adjusted is always based on an arrangement having a metal shielding.

Although the known plug type connector is therefore extremely flexible, with regard to the adjustment of the impedance, it is comparatively expensive to produce and is necessarily provided with a metal shell which, in addition to the shielding, also has the purpose of fixing the impedance tuner in a replaceable manner.

SUMMARY

In contrast, the problem addressed by the present invention is to provide an electrical connector of the type mentioned, which can be produced in a simple and cost-effective manner, and to adjust a stable impedance regardless of the presence of a shielding which surrounds it or an optionally provided earth plate or other metal housings.

This problem is solved by the subject-matter of the independent patent claim. Advantageous developments of the electrical connector according to the invention are set out in the dependent patent claims.

The present invention is based on the notion that, in order to adjust the impedance of the connector in at least a portion of the region in which the at least one contact element is arranged, at least one impedance equalisation element is provided on the contact carrier in such a manner that it is integrated therewith, that is to say, is permanently connected thereto after the production process. The impedance equalisation element has in particular an electrically conductive, substantially planar structure, which is arranged with respect to the at least one contact element with a predetermined spacing which is dependent on the impedance value to be adjusted. This impedance equalisation element according to the invention which is integrated in the contact carrier dominates the impedance behaviour of the unshielded connector. If an additional shielding is now fitted, it can be seen that, although the shielding has a degree of influence on the impedance of the connector, this influence is so small that the signal properties remain within the required limits. It must naturally be ensured that the housing shape ensures that the shielding maintains a given minimum spacing with respect to the contact element.

In a particularly simple manner, the impedance equalisation element according to the invention can be implemented by being produced from a metal sheet. Such a metal sheet can either also be introduced into the housing or be connected to the contact carrier in a non-releasable manner by means of a so-called stitch connection. It may also be advantageous to produce the housing in several parts, that is to say, from two halves, and to insert the metal sheet in one of the two halves before the assembly. In each case, there is no provision for the impedance equalisation element to be removed again after the assembly.

The contact element generally has a connection region for connecting a first external electrical component, for example, a cable, and a contact region for contacting a second external component, for example, of the mating connector pin, the connection region and the contact region being connected to each other by means of a connection region. According to the invention, an impedance equalisation element may be arranged both in the connection region and in the contact region and also in both regions at the same time. A stabilisation of the impedance at all critical connection points is thereby achieved.

In a particularly advantageous manner, the present invention can be used for electrical connectors in which a crimp connector is provided in the connection region of the contact element.

Alternatively, a press-in or solder connection and in particular an angled configuration may also be provided as a connection connector for contacting a printed circuit board (PCB). However, other connection possibilities may also be provided at this location, such as, for example, other plug type connections, so that the electrical connector according to the invention forms an adapter.

In most cases below, specific reference is made to the fact that the contact element is a socket element. Of course, however, a pin contact may also be provided with the impedance stabilisation according to the invention.

The dominance according to the invention of the impedance properties by the influence of the impedance equalisation element can be reliably achieved in particular by the impedance equalisation element extending in a substantially parallel manner along both longitudinal axes of the contact elements.

For a permanent connection of the impedance equalisation element to the contact carrier, there are various advantageous implementation possibilities. On the one hand, the impedance equalisation element may be integrated in the electrically insulating contact carrier, for example, therefore, cast in an injection-moulding operation. This procedure has the advantage that the adjustment of the spacing between the contact element and the impedance equalisation element critical for the function can be adjusted with relatively low tolerances. Alternatively, however, there may also be provision for the impedance equalisation element on the outer face of the contact carrier to be permanently connected to the contact carrier by means of a so-called stitching operation or any other suitable adhesive bonding or pressing-in procedure. As already mentioned, it may also be advantageous to produce the housing in several parts, for example, from two halves, and for the metal sheet to be inserted in one of the two halves before assembly. In any case, there is no provision for the impedance equalisation element to be removed again after assembly so that the impedance equalisation element is preferably connected to the contact carrier in a non-separable manner.

In particular when the impedance equalisation element is produced from a metal sheet, it can perform various additional functions on the electrical connector. For example, the impedance equalisation element may have at least one resilient element by means of which an electrically conductive shielding which is optionally mounted so as to surround the contact carrier can be fixed to the connector. Consequently, even when the connector is intended to be shielded, no additional retention members need to be fitted.

Furthermore, the impedance equalisation element may have one or more clamping projections in order to form a clamping connection together with a printed circuit board. Using such so-called board locks, as is generally known, plug type connectors can be mounted and retained on printed circuit boards as an alternative to a rivet or screw type fixing. The plug type connector which is connected to a board lock is pressed on the printed circuit board to be configured and the clamps engage or are under mechanical tension. The retention of such a clamping connection can be selected in such a manner that it is sufficient for retaining the plug type connector on the printed circuit board, for example, during a soldering operation. In the case of assembly bores which are plated through, by soldering the board lock the tension relief of the plug type connector can also be significantly further improved during the insertion and pulling operation.

Furthermore, the impedance equalisation element may also be provided with a crimp connector in order, for example, to contact the shield of a cable.

If the electrical connector according to the present invention is provided with an electrically conductive shielding, according to an advantageous embodiment the at least one impedance equalisation element may already form part of this shielding.

BRIEF DESCRIPTION OF THE DRAWINGS

In order to better understand the present invention, it is explained in greater detail with reference to the embodiments illustrated in the following Figures. Components which are the same are given the same reference numerals and the same component designations. Furthermore, some features or feature combinations from the embodiments shown and described may also constitute independent inventive solutions per se or solutions in accordance with the invention. In the drawings.

DETAILED DESCRIPTION

The present invention is intended to be explained in detail below with reference to the Figures.

Figure 1:
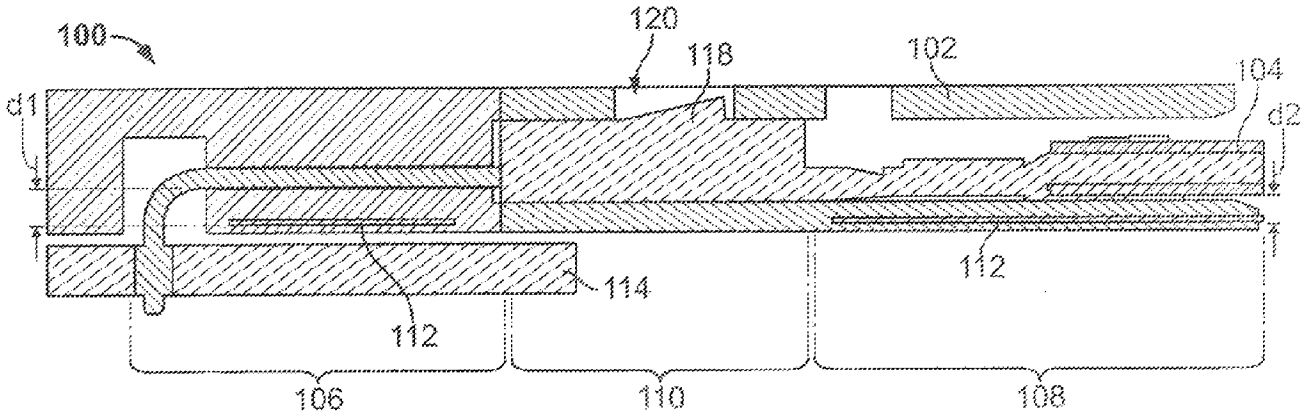
FIG. 1 is a sectioned view through an electrical connector which is mounted on a printed circuit board according to a first advantageous embodiment.

FIG. 1 is a sectioned view of the electrical connector 100 according to the invention when mounted on a printed circuit board (PCB) 114 according to a first advantageous embodiment. The electrical connector 100 comprises a contact carrier 102 which is produced from an appropriate electrically insulating material. In the specific embodiment shown here, it is a two-pole angled plug type connector, as used, for example, for a connection between a printed circuit board and a signal line. In this instance, as will become clear with reference to FIGS. 3 and 4, there are provided two contact elements 104 which are constructed as socket contacts. However, the principles according to the invention can also be applied to other connection configurations.

Each of the contact elements 104 has a connection region 106 with a connection connector 122, for example, a solder connection or a press-in connector, for electrically connecting the contact element 104 to a printed circuit board 114. A connection region 110 is connected to the actual contact region 108, which is configured for connection to a mating connector. In the embodiment illustrated, the contact region is constructed as a contact socket which can be electrically connected to a mating connector pin.

The contact elements 104 are secured by means of a catch arm 118 in corresponding catch openings 120 of the contact carrier 102. Furthermore, the contact carrier 102 is constructed in the illustrated embodiment in two parts so that the connection region 106 and the contact region 108 are located in portions of the contact carrier 102 that can be produced separately.

According to the invention, a metal impedance equalisation element 112 is integrated in the contact carrier 102, both in the connection region 106 and in the contact region 108. The respective length, width and the spacing d1 or d2 with respect to the contact element 104 are selected in such a manner that a specific value for the wave resistance, for example, 100 Ω, 50 Ω or 120 Ω, is adjusted. The order of magnitude of these spacings is in the range of a few tenths of a millimeter and the wave resistance becomes greater the further away the impedance equalisation element 112 is arranged from the contact element 104.

It may be shown that, owing to the arrangement of the impedance equalisation element 112 according to the invention, the impedance behaviour of the plug type connector 100 is influenced so strongly in a dominant manner that an additional shielding which surrounds the contact carrier only has more of a subordinate effect on the influence of the overall wave resistance. In the embodiment illustrated, impedance equalisation elements are provided both in the connection region 106 and in the contact region 108. However, this does not necessarily have to be the case; sometimes, owing to the precisely defined form of the contact sockets or connection connectors, adequate adjustment of the impedance is already ensured.

In the embodiment shown, the impedance equalisation element 112 is in each case cast as a metal punched/bent component in the plastics material of the contact carrier 102. This variant constitutes a form which can be produced in a particularly precise manner and in which the impedance equalisation element 112 is secured to the contact carrier 102 in a particularly good and stable manner. However, other, preferably non-releasable, connection variants can also be used and in particular the impedance equalisation element can also be pressed or clamped on the outer face of the contact carrier 102 into the plastics material or the impedance equalisation element can be retained inside a multi-component composite housing.

Figure 1A:
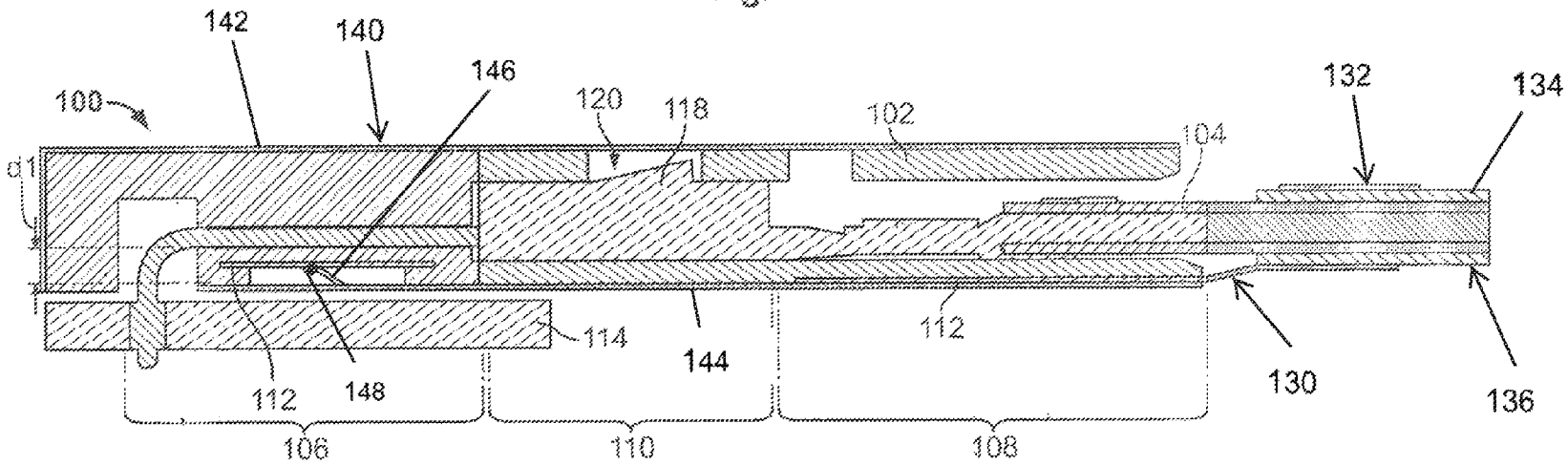
Figure 2:
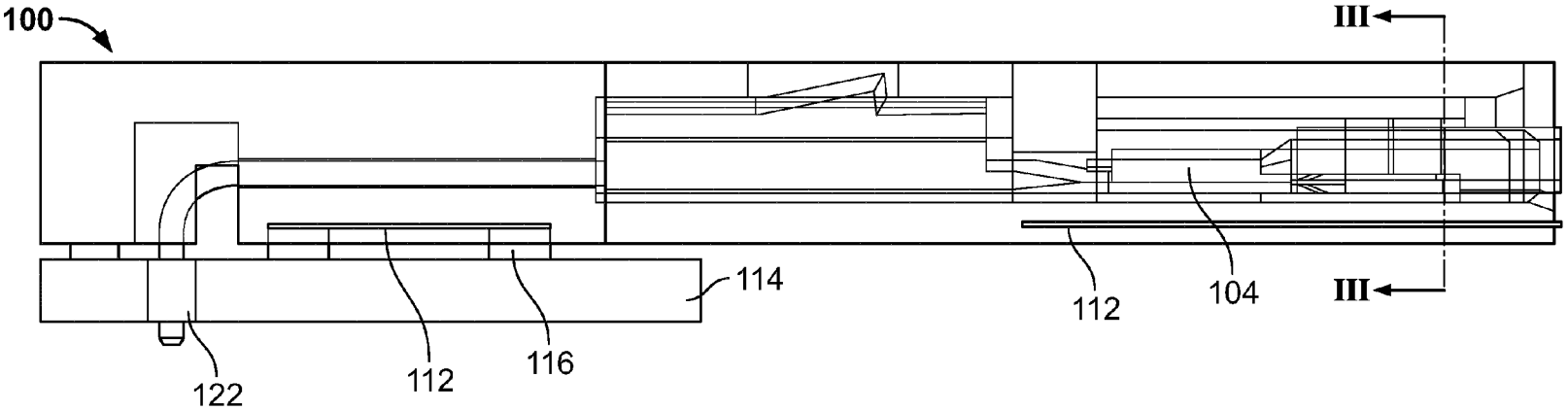
FIG. 2 is a side view with visible covered edges of the arrangement from FIG. 1.
Figure 4:
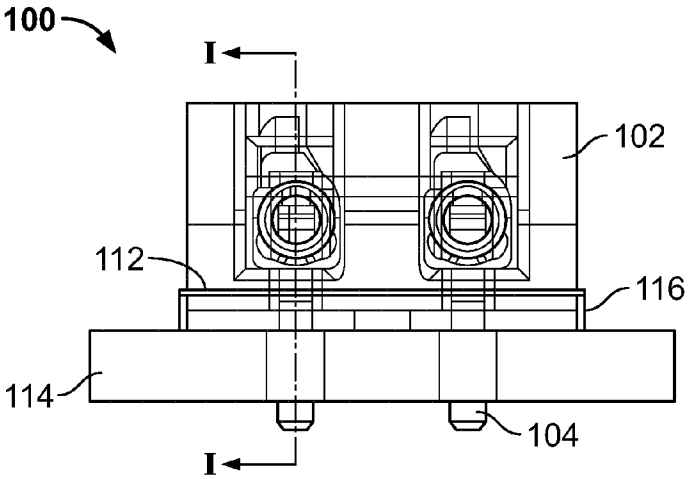
FIG. 4 is a front view of the plug type connector of FIG. 2.

As can be seen when FIGS. 2 and 4 are viewed together, the metal impedance equalisation elements may advantageously also assume additional functions. There are thus formed, for example, on the impedance equalisation element 112 which is located in the connection region 106 four board locks 116 which produce a clamping connection with respect to the printed circuit board 114. As already mentioned, the connector 100 can thereby be securely fixed to the printed circuit board 114 and, for the insertion operations, a tension relief system is ensured on the connection connector 122 for contacting the printed circuit board 114. Both in the case in which the connection connector 122 is constructed as a press-fitting connector and in the case of a solder connection, insertion operations can thus be effectively prevented from impairing the electrical contact with respect to the printed circuit board. It is illustrated in FIG. 1A that the respective impedance equalisation elements 112 may also have corresponding projections which may act as crimp lugs. For example, and with reference to FIG. 1A, equalisation element 112 includes a projection 130 having crimp lugs 132 for contacting the shielding 134 of cable 136.

Furthermore, locking projections or resilient projections which fix an additional metal shielding may also be formed. In this instance, the impedance equalisation element, since it is connected to the shielding in an electrically conductive manner, forms part of the shielding and also enables significantly improved shielding from the side of the printed circuit board when it is intended to be added retrospectively, without the plug type connector having to be released from the printed circuit board again. As shown best in FIG. 1A, electrical connector 100 includes shielding 140, which comprises an upper shield member 142 and a lower shield member 144. A resilient projection 146 extends from lower shield member 144 and can be fixed to the equalisation element 112, for example, by way of a spot weld 148.

Figure 3:
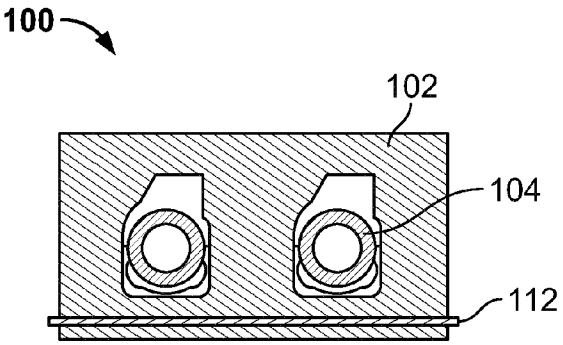
FIG. 3 is another sectioned view of the arrangement from FIG. 2.

As can be seen in FIGS. 3 and 4, the impedance equalisation element 112 is arranged according to the invention parallel with the contact elements 104 and has a precisely defined spacing relative thereto which is selected in such a manner that the impedance is adjusted to a predetermined value for the given spacing of the two contact elements 104 with respect to each other.

For some applications, it may be necessary to fit to the connector 100 an electrically conductive shielding which at least partially surrounds the contact carrier 102. Although the impedance is still influenced by such a shielding, since the influence of the metal impedance equalisation element 112 constitutes the dominant effect, no problems thereby arise with respect to the signal quality and the integrity of the signal remains within the required limits. It should be noted that a shielding must have a given minimum spacing with respect to the contact elements so that the influence of the impedance equalisation elements 112 actually remains the dominant effect.

Figure 6:
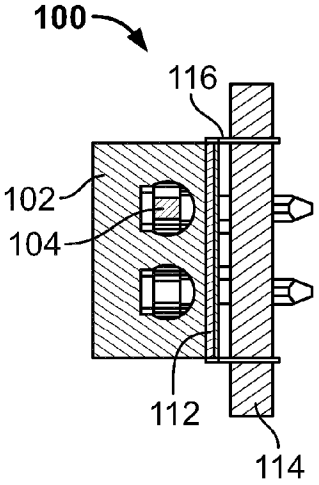
FIG. 6 is a first section through the arrangement of FIG. 5.
Figure 5:
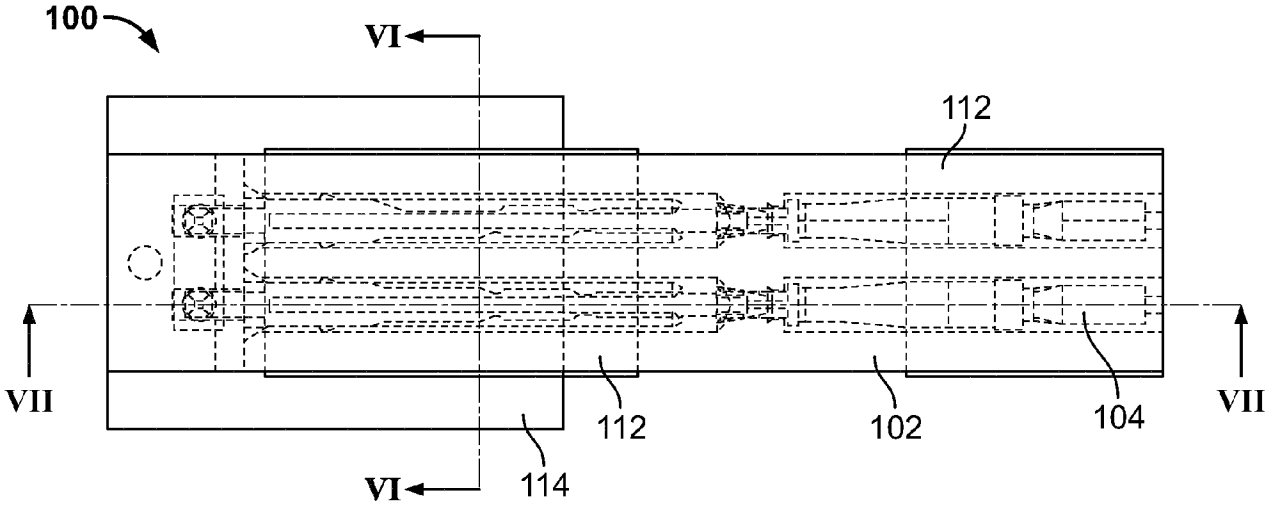
FIG. 5 is a plan view of a plug type connector according to a second embodiment.
Figure 7:
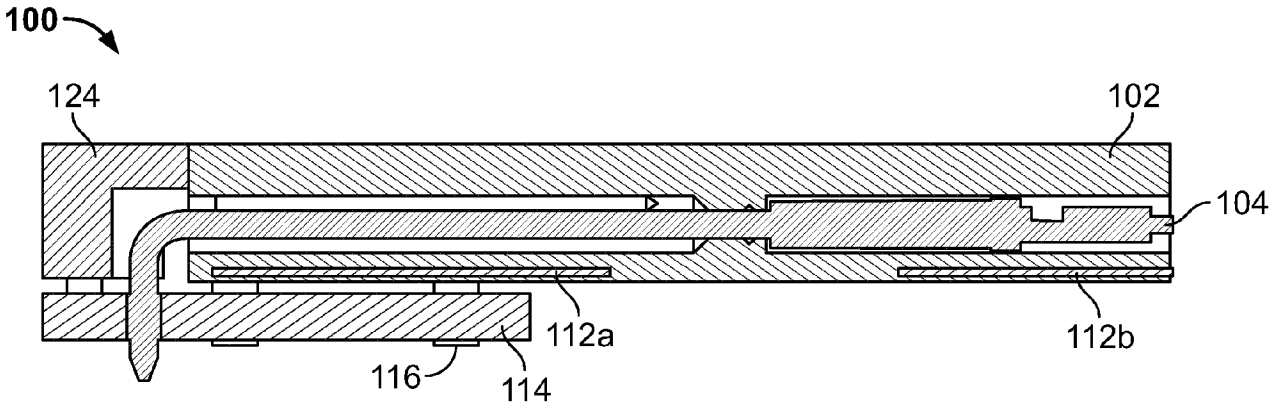
FIG. 7 is a second section through the arrangement of FIG. 5.

Another advantageous embodiment of the connector 100 according to the invention is shown in FIGS. 5 to 7. A significant difference here involves the dimensions of the impedance equalisation elements 112: in the connection region 106, a first impedance equalisation element 112*a* is longer than in the first embodiment, whilst the impedance equalisation element 112*b* which is arranged in the contact region is shorter. Furthermore, the contact carrier 102 in this embodiment is substantially in one piece and has only a covering cap 124 which equalises the impedance and which is provided to cover the angled press-fit connector with respect to the printed circuit board 114.

The principles according to the invention have always been explained above for the example of an Ethernet connection with two plug contacts. However, such impedance equalisation elements may also be produced for single-poled plug type connectors or those with more than two contacts. Either continuous metal faces can be provided for an entire plurality of contacts, or a separate impedance equalisation element may be associated in each case with a defined group of contacts.

It is important that the impedance equalisation elements according to the invention have a stabilising effect on an adjusted impedance so that within predetermined tolerance ranges, it makes no difference to the signal quality whether an electrically conductive shielding is further provided on the plug type connector 100. Furthermore, for the shielded and unshielded version with respect to pitch and spatial shape, precisely the same connectors can be used, which saves time and costs in particular in the automotive sector.

| List of reference numerals | |
|---|---|
| 100 | Electrical connector |
| 102 | Contact carrier |
| 104 | Contact elements, contact sockets |
| 106 | Connection region of the contact sockets |
| 108 | Contact region of the contact sockets |

-continued

| List of reference numerals | |
|---|---|
| 110 | Connection region |
| 112 | Impedance equalisation element |
| 114 | Printed circuit board |
| 116 | Board lock |
| 118 | Catch arm |
| 120 | Catch opening |
| 122 | Connection connector |
| 124 | Covering flap |

The invention claimed is:

1. An electrical connector having an electrically insulating contact carrier and having an electrically conductive contact element which is retained in the contact carrier, wherein, in order to adjust the impedance of the connector in at least a portion of the region in which the at least one contact element is arranged, at least one impedance equalisation element is provided on the contact carrier and integrated therewith, wherein the impedance equalisation element has an electrically conductive, substantially planar structure, which is arranged with respect to the at least one contact element with a predetermined spacing which is dependent on an impedance value to be adjusted, wherein the at least one impedance equalisation element is integrated within the electrically insulating contact carrier, and the contact carrier is produced as an injection molded component and the at least one impedance equalization element is cast therein; and wherein the at least one impedance equalisation element has at least one crimp connector for connecting an electrical cable.

2. An electrical connector according to claim 1, wherein the at least one impedance equalisation element is produced from a metal sheet.

3. An electrical connector according to claim 1, wherein the contact element has a first connection region for connecting a first external component and a contact region for contacting a second external component, wherein the first connection region and the contact region are connected to each other by means of a second connection region and wherein the at least one impedance equalisation element is/are arranged in the first connection region and/or the contact region.

4. An electrical connector according to claim 3, wherein the at least one contact element in the connection region is constructed in an angled manner so that it can be inserted into a printed circuit board.

5. An electrical connector according to claim 3, wherein two contact elements are provided and the at least one impedance equalisation element is arranged in such a manner that it extends in the contact region along both longitudinal axes of the contact elements.

6. An electrical connector according to claim 1, wherein the at least one impedance equalisation element has at least one resilient element for fixing an electrically conductive shielding which can be mounted so as to surround the contact carrier.

7. An electrical connector according to claim 1, wherein the at least one impedance equalisation element has at least one clamping projection for constructing a clamping connection in conjunction with a printed circuit board.

8. An electrical connector according to claim 1, further comprising an electrically conductive shielding which at least partially surrounds the contact carrier, wherein the at least one impedance equalisation element forms a part of the shielding.

9. An electrical connector having an electrically insulating contact carrier and having an electrically conductive contact element which is retained in the contact carrier, wherein, in order to adjust the impedance of the connector in at least a portion of the region in which the at least one contact element is arranged, at least one impedance equalisation element is provided on the contact carrier and integrated therewith;

wherein the impedance equalisation element has an electrically conductive, substantially planar structure, which is arranged with respect to the at least one contact element with a predetermined spacing which is dependent on an impedance value to be adjusted;

wherein the at least one impedance equalisation element is integrated within the electrically insulating contact carrier, and the contact carrier is produced as an injection molded component and the at least one impedance equalization element is cast therein; and wherein the at least one impedance equalisation element has at least one resilient element for fixing an electrically conductive shielding which can be mounted so as to surround the contact carrier.

10. An electrical connector having an electrically insulating contact carrier and having an electrically conductive contact element which is retained in the contact carrier, wherein, in order to adjust the impedance of the connector in at least a portion of the region in which the at least one contact element is arranged, at least one impedance equalisation element is provided on the contact carrier and integrated therewith;

wherein the impedance equalisation element has an electrically conductive, substantially planar structure, which is arranged with respect to the at least one contact element with a predetermined spacing which is dependent on an impedance value to be adjusted;

wherein the at least one impedance equalisation element is integrated within the electrically insulating contact carrier, and the contact carrier is produced as an injection molded component and the at least one impedance equalization element is cast therein; and further comprising an electrically conductive shielding which at least partially surrounds the contact carrier, wherein the at least one impedance equalisation element forms a part of the shielding.

* * * * *